US007578148B2

(12) United States Patent
McMurray

(10) Patent No.: US 7,578,148 B2
(45) Date of Patent: Aug. 25, 2009

(54) COLOR-FAST STRETCH MATERIAL AND METHOD OF MAKING SAME

(75) Inventor: Brian L. McMurray, Lincolnton, NC (US)

(73) Assignee: McMurray Fabrics, Inc., Aberdeen, NC (US)

( * ) Notice: Subject to any disclaimer, the term of this patent is extended or adjusted under 35 U.S.C. 154(b) by 703 days.

(21) Appl. No.: 10/651,443

(22) Filed: Aug. 30, 2003

(65) Prior Publication Data

US 2005/0044897 A1 Mar. 3, 2005

(51) Int. Cl.
*D04B 23/06* (2006.01)

(52) U.S. Cl. ..... 66/202; 66/172 E

(58) Field of Classification Search ..... 66/202, 66/169 R, 170, 171, 172 E; 139/421; 442/182, 442/184, 306
See application file for complete search history.

(56) References Cited

U.S. PATENT DOCUMENTS 3,324,686 A * 6/1967 Rosenstein ..... 66/187
3,701,164 A * 10/1972 Blore ..... 2/409
5,533,789 A * 7/1996 McLarty et al. ..... 297/452.64
6,068,666 A 5/2000 Amick
6,308,535 B1 10/2001 Sangiacomo
6,435,221 B1 * 8/2002 Waldrop et al. ..... 139/422
6,688,143 B2 * 2/2004 Williams ..... 66/195
6,769,146 B2 * 8/2004 Copeland et al. ..... 297/452.61

* cited by examiner

*Primary Examiner*—Danny Worrell
(74) *Attorney, Agent, or Firm*—MacCord Mason PLLC

(57) ABSTRACT

A color-fast material and method of making same, the material having a combination of a first component with substantial stretch properties and a second component with substantially lower stretch properties than those of the first component wherein the material is a fabric manufactured by knitting, weaving, non-woven or other fabric manufacturing process and the material is dyed prior to fabric formation for providing a material having superior color-fastness and color-uniformity in both stretched and relaxed states.

17 Claims, 2 Drawing Sheets

COLOR-FAST STRETCH MATERIAL AND METHOD OF MAKING SAME

BACKGROUND OF THE INVENTION (1) Field of the Invention

The present invention relates generally to textile materials and, more particularly, to a color-fast stretch material and method of making it.

(2) Description of the Prior Art

Typically, prior art textile materials or fabrics are produced by a variety of manufacturing methods, including but not limited to knitting, weaving, nonwovens manufacturing, and are further processed based upon intended end uses, including but not limited to coloring the fabric to a desired color and shade.

U.S. Pat. No. 6,068,666 to Amick, et al. discloses a blended fiber garment over dyeing process wherein garments are dyed in a two-stage process to yield outstanding colorfastness, pilling resistance, dimensional stability and durability. More particularly, Amick teaches dyeing the cellulosic fiber portion of the garments, and dyeing the synthetic polymeric fiber portion of the garments at temperatures and pressures above atmospheric conditions.

U.S. Pat No. 6,308,535 to Sangiacomo teaches a method for the manufacture of designed knitwear on circular stocking knitting and knitting machines is provided using one or more feed stations, starting from a first base yarn and from a second base yarn for the manufacture of a basic knit fabric and from at least one dyed yarn to create a design in the basic knit fabric. By way of contrast the present invention is not directed as mutliple yarn components dyed separately in order to produce a noticeable pattern in the finished fabric.

Prior art coloring methods commonly employ either dyeing yarns prior to fabric formation and/or to dyeing finished fabric or garments. However, where a stretch component is included in the fabric, the dyeing processes and parameters that are suitable to a similar fabric not having a stretch component may not be appropriate in order to realize the same finished coloration for the stretch-component fabric as for that of the fabric without it. More particularly, stretch components such as LYCRA cannot be processed at the same temperatures for coloration processing as for certain synthetic components such as polyethylene terephthalate (PET) polyester which may require disperse dyestuffs applied at as high as 260 degrees Fahrenheit under pressure, as these temperatures typically degrade the performance properties of the stretch component, thereby having a negative impact on the properties of the finished fabric or garment. However, without fabric- or garment-dyeing color uniformity is not ensured in the finished fabric or garment; in particular, noticeable differences between the stretch component and non-stretch components provide objectionable non-uniformity in the finished fabric or garment that is readily noticeable to the end user or consumer during product use, especially in garments having high stretch when worn. Unfortunately, processing the fabric or garment at lower temperatures so as not to degrade or diminish the performance properties of the stretch component in the finished product typically produces a non-color-fast material, wherein fading occurs over time due to cleaning and wear, and color non-uniformity can also result, even before use.

Solution dyeing has also been known in the prior art for yarn dyeing. However, the applications known have not addressed the problems in dealing with multiple yarn types for the fabric constructions and applications set forth hereinabove.

Thus, there remains a need for a color-fast stretch material having uniform color properties while maintaining the optimal performance properties of the stretch component within the material.

SUMMARY OF THE INVENTION

The present invention is directed to a color-fast material having a combination of stretch and non-stretch components therein.

In the preferred embodiment, the color-fast material may be manufactured as a knit, woven, non-woven, or other fabrication method for producing a fabric, wherein the fabric is formed of at least two yarn types, a first component having significant stretch or elastomeric properties and a second component having substantially lower stretch or elastomeric properties than the first component, and wherein the fabric is dyed after fabric formation at temperatures suitable to ensure color-fastness in both the first and second components without significantly degrading the properties of either component. Preferably, the second component is a synthetic yarn.

The present invention is further directed to a method for manufacturing the color-fast material having said properties and components.

It is an object of the present invention to provide warp knitted and weft knitted fabrics with better locked-in color consistency from lot to lot through manufacturing and the life of the garment than standard commercial state of the art fabrics previously available in the marketplace.

It is another object of the present invention to provide stretch knitted fabrics engineered for performance specifications using special yarn, fabric construction, and manufacturing process with minimal variation between lots.

It is yet another object of the present invention to provide fabric engineered for specific end-use garment applications while providing superior performance and garment care cleaning properties.

It is still another object of the present invention to provide a method of making fabrics with a process that essentially eliminates normal textile related variables while simultaneously accomplishes the specification fabric manufacturing in a minimum number of steps.

It is further an object of the present invention to disclose a process and method of making stretch or non-elastic fabrics that avoid using environmentally unfriendly dyestuffs and chemicals, and simultaneously requires much less energy consumption within the process than standard state of the art fabric making commercial practices.

It is also an object of the present invention to provide specification knitted fabrics containing such unique performance properties as anti-bacterial, hydrophyllic and/or hydrophobic moisture maintenance functions and/or systems, and quick drying properties.

Thus, the present invention provides a color-fast material having a combination of stretch and substantially non-stretch or non-elastomeric components therein wherein the material coloration is substantially uniform in both stretched and relaxed states.

Accordingly, one aspect of the present invention is to provide a color-fast material having a combination of a first component with substantial stretch properties and a second component with substantially lower stretch properties than those of the first component wherein the material is a fabric manufactured by knitting, weaving, non-woven or other fabric manufacturing process and the material is dyed prior to fabric formation for providing a material having a color-fastness and color-uniformity in both stretched and relaxed states.

Another aspect of the present invention is to provide a method for making said color-fast material.

These and other aspects of the present invention will become apparent to those skilled in the art after a reading of the following description of the preferred embodiment when considered with the drawings.

DETAILED DESCRIPTION OF THE PREFERRED EMBODIMENTS

Figure 1B:
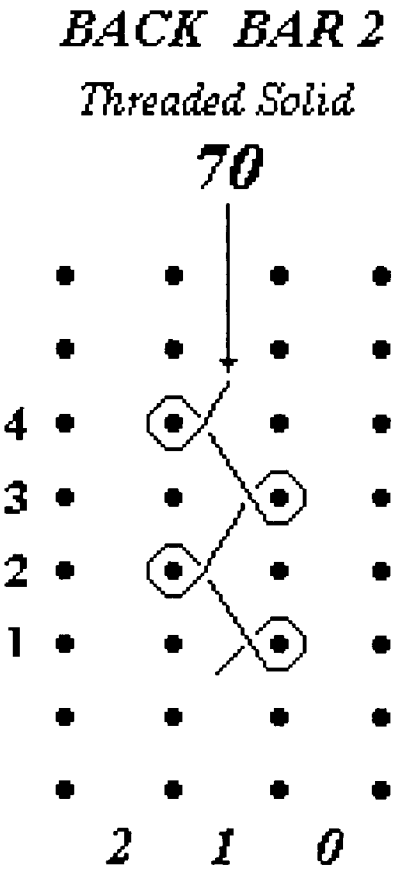
FIGS. 1A and 1B are a knitting pattern for a preferred embodiment according to the present invention.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms. Also, referring to the drawings in general, the illustrations are for the purpose of describing a preferred embodiment of the invention and are not intended to limit the invention thereto.

The present invention includes a color-fast material having a combination of a first component with substantial stretch or elastomeric properties and a second component with substantially lower stretch or elastomeric properties than those of the first component, or even substantially non-elastomeric properties, wherein the material is a fabric manufactured by knitting, weaving, non-woven or other fabric manufacturing process and at least one component, preferably the second substantially lower stretch material is dyed prior to fabric formation for providing a material having a color-fastness and color-uniformity in both stretched and relaxed states and method of making said color-fast material.

In a preferred embodiment of the present invention, the first component is a stretch component such as a SPANDEX, typified by the commercially available LYCRA supplied by DuPont, and the second component does not include an elastomeric SPANDEX or similar yarn material. The spandex yarn component may be solution dyed during the spinning process, or a natural non-colored clear, bright, or dull luster. While the second component is referred to as non-stretch, it is considered so with respect to the first component and as will be recognized and understood by one of ordinary skill in the art that most textile yarn components have some measurable degree of stretch, normally described as elongation and expressed as a percentage of increase of the fiber length over it's original relaxed measured length, even without including a stretch-specific or elastomeric material such as spandex. Preferably, the second component is a synthetic component selected from the group consisting of nylon, polyester, olefin, rayon, acrylic, modacrylic, acetate, triacetate, and the like, and combinations or varieties thereof, the synthetic component being substantially non-elastomeric when compared with the first component's properties. Other synthetic yarns may also be used. Alternatively, natural fibers and yarns may be employed as the second yarn component, including but not limited to cotton, wool, silk, cashmere, or other vegetable cellulosic or protein animal hair fibers, and the like, and combinations thereof. Preferably, the fabric of the present invention uses one or more from a combination of solution dyed thermal heat settable synthetic continuous filament yarns selected from a group consisting of Polyamide (Nylon), Polyester, Olefin (Polypropylene), Spandex, or the like as a prime ingredients for the fabrics. Alternatively, 100% same yarn non-elastic fabrics, as well as preferred embodiments such as fabric yarn combinations of solution dyed Spandex with solution dyed nylon or polyester.

A method of making the color-fast material according to the present invention includes the steps of providing a first yarn component and a second yarn component for inclusion in a fabric; treating the yarn components separately, such as by solution dyeing during the fiber spinning process at least one of the yarn components; fabricating a material from the yarn components. Additional steps may also preferably be included in the present invention, depending upon the material's end uses, such steps including but not limited to scouring the fabric; treating the fabric, such as with a finish for enhanced fabric performance, including anti-microbial, stain resistant, water resistant, water repellant, wicking agents and/or treatments, and combinations thereof. Further fabric processing including garment manufacturing may also be included.

Preferably, products using the fabric made according to the present invention are suited for a variety of applications, including but not limited to active wear, athletic wear, fitness wear, fashion swimwear, competition swimwear, intimate apparel, and such garment applications requiring fabric with superior aesthetics, superior and durable color retention through robust multiple cleaning and laundering cycles, and outstanding uniformity and consistency of colors repeating from lot to lot throughout manufacturing over time. More particularly, in a preferred embodiment, the fabric made according to the present invention is warp- or weft-knitted superior performance fabric, including a stretch or elastomeric and a substantially non-elastomeric components having color-fastness for both components such that when the fabric is stretched, the color properties of the overall fabric do not exhibit substantial differences between the components as compared to the relaxed, non-stretched fabric state.

Also, preferably the present invention further includes specification knitted fabrics containing such unique performance properties as anti-bacterial, hydrophyllic/hydrophobic moisture maintenance functions/systems, enhanced chlorine resistance, and quick drying properties. Such specification fabrics are preferably provided for applications where superior performance stretch fabrics are designed and employed for active wear, athletic wear, fitness wear, competition swimwear, intimate apparel, and such garment applications requiring fabric with superior aesthetics, superior and durable color retention through robust multiple cleaning and laundering cycles, and outstanding uniformity and consistency of colors repeating from lot to lot throughout manufacturing over time. In particular, in the case of competition swimwear, the fabric is typically exposed to chlorine on a daily basis, in its use in chlorinated swimming pools and repeated cleaning thereafter, where such rigorous treatment may also require a chlorine-resistant spandex, in addition to the processing according to the present invention, In particular, the present invention provides for warp knitted and weft knitted fabrics with better locked-in color consistency from lot to lot through manufacturing and the life of the garment than standard commercial state of the art fabrics previously available in the marketplace. Such types of stretch knitted fabrics, which are typically engineered for specific end-use garment applications while providing superior performance and garment care cleaning properties, and/or engineered for performance specifications using special yarn, fabric construction, and manufacturing process with minimal variation between lots, are particularly well-suited applications for the fabric manufactured according to the present invention.

Thus, the present invention provides a method of making fabrics with a process that essentially eliminates many of the normal textile related variables associated with the wet process of dyeing and applying color to the raw materials used while simultaneously accomplishes the specification fabric manufacturing in a minimum number of steps. Furthermore, the method of making stretch or non-elastic fabrics according to the present invention avoids using environmentally unfriendly dyestuffs and chemicals such as those applied in a wet dyeing process, and simultaneously requires much less energy consumption within the process than standard state of the art fabric making commercial practices.

In another embodiment according to the present invention, the elastomeric or stretch yarn component, preferably spandex, is solution dyed. While in many cases the solution dyed spandex is provided in colors to match the non-elastomeric yarn component, in particular a synthetic yarn component that is also solution dyed, the present invention includes a solution dyed elastomeric yarn, in particular solution dyed spandex that is dyed in a predetermined shade selected from dark shades including black, gray, and navy, such that the solution dyed spandex does not precisely match the solution dyed non-elastomeric yarn. While prior art typically strives for matching yarns coloration and/or shading, the present invention provides for solution-dyed yarn components that retain their coloration better over time, but wherein components within the fabric having different properties, i.,e., elastomeric versus non-elastomeric, are intended to have slightly different coloration such that the visual effect of the finished fabric appears to be substantially the same or similar coloration when in either a relaxed or non-stretch state when compared with a stretched state. As such, the present invention provides for the fabric in a relaxed state to have the appearance of a consistent color throughout the fabric, as well as in a stretched state, even though the yarn components are not intended to match as closely as possible. This provides for better consistency from lot-to-lot for each of the solution dyed yarn components and commercially in finished products as set forth hereinabove after garment use, wear, and cleanings, due to the fabric using solution-dyed yarns.

In yet another alternative embodiment according to the present invention, a non-solution-dyed spandex may be used as the elastomeric component. Such spandex component is provided in clear, bright, and/or dull finishes, and subsequently dyed in a less hostile, below-the-boil dyeing process, where by contrast, the non-elastomeric yarn is solution-dyed.

DESIGN EXAMPLE(S)

This section outlines a few design examples, not necessarily optimized, but illustrative of what can be done for a fabric formed according to the present invention as set forth in the foregoing. These design examples include:

Example 1

Figure 1A:
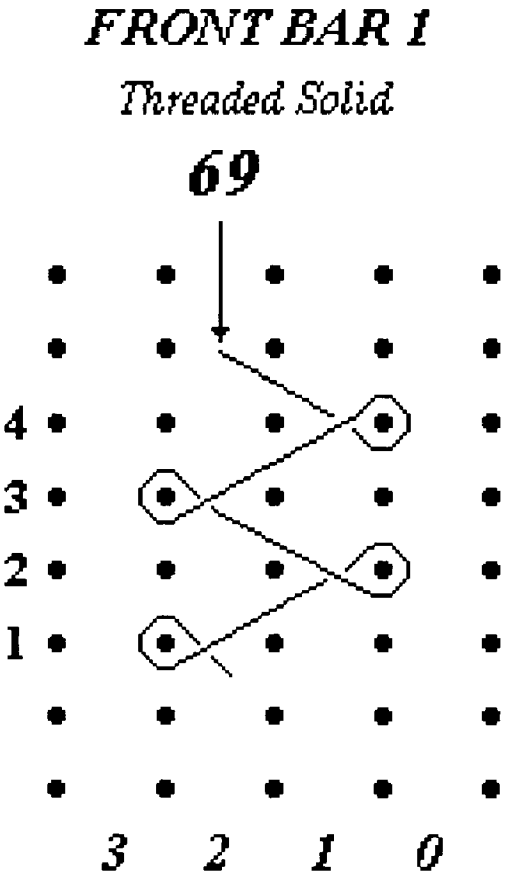

In this preferred embodiment of the fabric as set forth in the foregoing, as shown in FIG. 1A and 1B, illustrates a knitting pattern for a 2-bar warp knit tricot jersey fabric wherein the front bar is solid threaded with solution dyed synthetic continuous multifilament or monofilament yarn 69, as shown in FIG. 1A. The back bar is solid threaded with solution dyed SPANDEX elastomeric yarn 70, as shown in FIG. 1B.

Example 2

Figure 2:
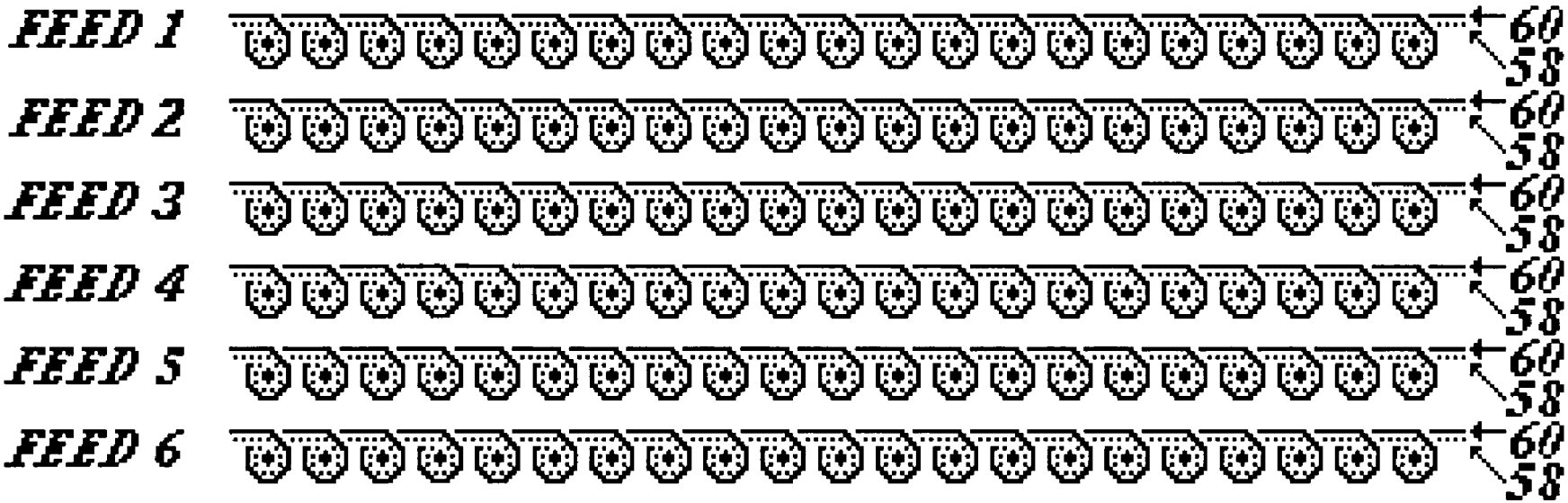
FIG. 2 is a knitting pattern of an alternative embodiment of the present invention.

In this preferred embodiment of the fabric as set forth in the foregoing, as shown in FIG. 2, illustrates a knitting pattern for a weft-knit single jersey fabric with all feeds knitting on all needles of the cylinder. A solution dyed synthetic continuous multifilament yarn 60 is plaited along with a solution dyed spandex elastomeric yarn 58 in all feeds. As depicted, six feeds are shown in FIG. 2 for the purpose of illustration only as it will be understood by those skilled in the art that the number of yarn feeds and their knit instruction according to the knitting sequence will be dependant upon the individual circular weft knit machine and the diameter of the cylinder relative to the number of yarn feed positions that are appropriate for a specific machine circumference and the number of different feeds required to complete the knitting construction sequence that will repeat evenly about the circumference of the cylinder accordingly.

Certain modifications and improvements will occur to those skilled in the art upon a reading of the foregoing description. By way of example, a fabric may contain a solution dyed spandex yarn ingredient and solution dyed nylon or polyester yarn ingredients plus a third un-dyed yarn ingredient that can be colored in fabric form by over-dying, thereby simplifying the dyeing process thus minimizing the number of steps in the total fabric coloration process, as well as the number of stock keeping units associated with multiple colorations of fabric being tracked in the particular fabric style inventory All modifications and improvements have been deleted herein for the sake of conciseness and readability but are properly within the scope of the following claims.

What is claimed is:

1. A knitted fabric consisting essentially of:

a first, solution dyed component having a percent elongation at break of greater than 100%, wherein the first component is formed into a loop; and a second component with substantially lower stretch properties than those of the first component, wherein the second component is formed into a second loop; wherein the components are dyed prior to fabric formation for providing a knitted fabric having color-uniformity in both stretched and relaxed states, and wherein the fabric does not include a laid-in yarn.

2. The knitted fabric according to claim 1, wherein at least one of the components is solution dyed.

3. The knitted fabric according to claim 1, wherein both of the components are solution dyed.

4. The knitted fabric according to claim 1, wherein the fabric is a warp-knitted fabric.

5. The knitted fabric according to claim 1, wherein the fabric is a weft-knitted fabric.

6. The knitted fabric according to claim 1, wherein the components are dyed separately.

7. The knitted fabric according to claim 1, wherein the second component is synthetic.

8. The knitted fabric according to claim 7, wherein the second component is polyester.

9. The knitted fabric according to claim 1, wherein the components comprise solution dyed thermal heat settable synthetic continuous filament yarns selected from a group consisting of Polyamide (Nylon), Polyester, Olefin (Polypropylene), Spandex, and combinations thereof.

10. The knitted fabric according to claim 1, wherein the fabric includes additives to provide performance properties including anti-bacterial, hydrophyllic, hydrophobic, resistance to chlorine, quick drying, and combinations thereof.

11. A stretch fabric comprising:

a first, solution dyed elastomeric component having a percent elongation at break of greater than 100% and forming a first loop, and a second substantially non-elastomeric component forming a second loop, wherein the stretch fabric is formed by interconnecting the first component and the second component; and wherein the first component and second component are solution-dyed prior to fabric formation, and wherein the fabric does not include a weft inserted yarn, thereby providing a stretch fabric having color-uniformity in both stretched and relaxed states.

12. The stretch fabric according to claim 11, wherein the components comprise solution dyed thermal heat settable synthetic continuous filament yarns selected from a group consisting of Polyamide (Nylon), Polyester, Olefin (Polypropylene), Spandex, and combinations thereof.

13. A method of making and processing a stretch fabric comprising the steps of:

providing a first yarn component and a second yarn component for inclusion in a fabric;

dyeing the yarn components separately;

fabricating a fabric from the yarn components, the first component having substantial stretch properties and the second component having substantially lower stretch properties than those of the first component, thereby providing a stretch fabric having color-uniformity in both stretched and relaxed states, wherein the fabricating does not include inserting a weft yarn; and processing the stretch fabric having color-uniformity in both stretched and relaxed states into a garment.

14. The method according to claim 13, wherein the step of fabricating the fabric includes manufacturing by knitting, weaving, non-woven or other fabric manufacturing process.

15. The method according to claim 13, further including the steps of scouring the fabric and/or treating the fabric.

16. The method according to claim 15, wherein the step of treating the fabric includes applying a finish for enhanced fabric performance.

17. The method according to claim 16, wherein the finish includes anti-microbial, stain resistant, water resistant, water repellant, wicking agents and/or treatments, and combinations thereof.

* * * * *